US006182319B1

(12) United States Patent
Maier et al.

(10) Patent No.: US 6,182,319 B1
(45) Date of Patent: Feb. 6, 2001

(54) ARRANGEMENT ON WHICH IT IS POSSIBLE TO WALK AND/OR DRIVE

(75) Inventors: Peter Maier, Rielasingen; Branislav Kmet, Gottmadingen, both of (DE)

(73) Assignee: Peter Maier Leichtbau GmbH (DE)

( * ) Notice: Under 35 U.S.C. 154(b), the term of this patent shall be extended for 0 days.

(21) Appl. No.: 09/235,086

(22) Filed: Jan. 21, 1999

(30) Foreign Application Priority Data

Feb. 14, 1998 (DE) ..... 198 06 145

(51) Int. Cl.[7] ..... E01D 6/00; E01D 19/00; E01D 21/00

(52) U.S. Cl. ..... 14/4; 14/13

(58) Field of Search ..... 14/4, 6, 13, 27, 14/17, 24

(56) References Cited

U.S. PATENT DOCUMENTS

Re. 6,444 * 5/1875 Eads ..... 14/24
682,500 * 9/1901 Shafer ..... 14/13
4,015,303 * 4/1977 Eyb et al. ..... 14/27
4,200,946 * 5/1980 Lawerence ..... 14/4
4,253,210 * 3/1981 Racicot ..... 14/17
5,065,467 * 11/1991 Forsyth ..... 14/13
5,724,691 * 3/1998 Wiedeck et al. ..... 14/4
5,924,152 * 7/1999 Maier ..... 14/4

* cited by examiner

*Primary Examiner*—Eileen D. Lillis
*Assistant Examiner*—Raymond W Addie
(74) *Attorney, Agent, or Firm*—Bachman & Lapointe, P.C.

(57) ABSTRACT

In the case of an arrangement on which it is possible to walk and/or drive and which is intended for bridging over and/or under, for example, roads, comprising a bottom member (1) which is connected, via cross-struts (2), to handrails (10) and/or a top flange (3), the intention is for a cross-strut (2) to comprise, at least in part, a box profile.

23 Claims, 6 Drawing Sheets

ARRANGEMENT ON WHICH IT IS POSSIBLE TO WALK AND/OR DRIVE

This application claims priority from German Application 198 06 145.5 filed Feb. 14, 1998.

The invention relates to an arrangement on which it is possible to walk and/or drive and which is intended for bridging over and/or under, for example, roads, comprising a bottom member which is connected, via cross-struts, to handrails and/or a top flange.

An arrangement of this type is known, for example, from DE 196 25 819.7 A1, which corresponds to U.S. Pat. No. 5,924,152. An essential feature of this invention is the fact that virtually the entire arrangement can be produced in modular fashion. The arrangement essentially comprises aluminum profiles which are lightweight and can be produced cost-effectively. The object of the present invention is further to improve this arrangement on which it is possible to walk, and is known from DE 196 25 819 A1, and also to make it suitable for new applications.

In order to achieve this object, a cross-strut comprises, at least in part, a box profile. The intention is for this box profile to be used preferably at a large number of locations of the arrangement according to the invention, these being, in addition to said cross-struts, also top flanges or additional tension struts or rods, roof struts, etc. The components are to be standardized as far as possible in order that the arrangement as a whole manages with a minimum number of different components.

A box profile has the advantage that it has considerably improved stability. It is also possible, however, for additional profilings to be integrally formed on the box profile, these profilings being used for receiving and/or the insertion of further structural elements. The various possibilities are described hereinbelow.

The box profile, however, also makes it possible for a cross-strut to be better connected to a bottom member than has been the case hitherto. For this purpose, the invention provides a Y-shaped connecting piece which is fixed on the bottom member. For example, fixing can take place on a joint rod which, at the same time, connects two panels of the bottom member to one another in the manner of a piano hinge. Projecting to the side from the connecting piece are two branches, onto which in each case one cross-strut is plugged. In this case, the branches are configured such that they are supported by their spine and supporting fingers in the interior of the cross-strut.

A push-in depth of the cross-strut is limited by a stop on the branch. The cross-strut is further fixed by means of the securing bolt.

A further problem of the arrangement according to the invention is in the task of making sides safe, it being the case that the triangles formed by the cross-struts are usually too large. These triangles should also be filled with a side panelling, with the result that it is no longer possible for even a child to fall through them.

The material of which the side panelling consists is of secondary importance, but a plastic panel or safety glass is conceivable, in particular.

Serving for securing the side panelling, on the one hand, are parts of the above-mentioned profiling on the box profile, for example receiving channels, into which the side panelling is inserted. For the purpose of fixing the side panelling with respect to the bottom member or with respect to a handrail, specific clamping devices are also provided and these, in the present, preferred exemplary embodiments, comprise a clamping holder and a clamping piece. In this case, it is intended that the clamping devices can be used both in relation to the handrail and in relation to the bottom member.

The clamping piece and clamping holder are connected to one another such that it is possible to change a spacing between the two. It is thus also possible to use the same clamping devices for side panellings of different thicknesses. For example, the clamping piece may be connected to the clamping holder in an articulated manner if there is a second connection via a tension bolt, by means of which the spacing between the clamping piece and clamping holder is changed.

In many cases, it is not sufficient for the bottom member to be stiffened by the cross-struts alone. In this case, it has proven to be advisable also to arrange a tension bar between two cross-struts, said tension bar being connected vertically to the bottom member. The tensile forces, which act essentially on the bottom member, are better absorbed as a result. The same also applies to the buckling forces, which also act essentially in the downward direction.

The vertical tension bar may also advantageously be used, in particular, when the arrangement on which it is possible to walk and/or drive is enclosed. In this case, the cross-struts and the tension bar extend to a height of approximately 2.40 meters and are connected, at this level, to a top flange. Connection preferably takes place at a joint location which is covered over by corresponding side elements.

In order to improve the stability, two parallel top flanges are connected to one another by roof struts. Additional roof surfaces may also be positioned on the top flanges and the roof struts. In order that these roof surfaces are supported in relation to the top flanges, elastic material strips, for example foam-rubber strips, may be introduced into corresponding profilings of the top flanges.

In another use example, an arrangement according to the invention on which it is possible to walk and/or drive serves for bridging over, for example, areas at risk of flooding. For this purpose, it is provided that a corresponding bottom member is assigned supports for providing support on an underlying surface. These supports have brackets which are arranged in a displaceable manner along the supports. The bottom member rests on the brackets, with the result that it can be adjusted in height in relation to the underlying surface. Furthermore, it is also intended for the supports themselves to be designed such that they can be telescoped, with the result that the bottom member can be raised.

Two supports are each connected to one another at their top end via an articulation, it being the case that a suspension means, in turn, hangs down from this articulation, the bottom member being fastened on said suspension means.

Further advantages, features and details of the invention can be gathered from the following descriptions of preferred exemplary embodiments and with reference to the drawing, in which.

Figure 1:
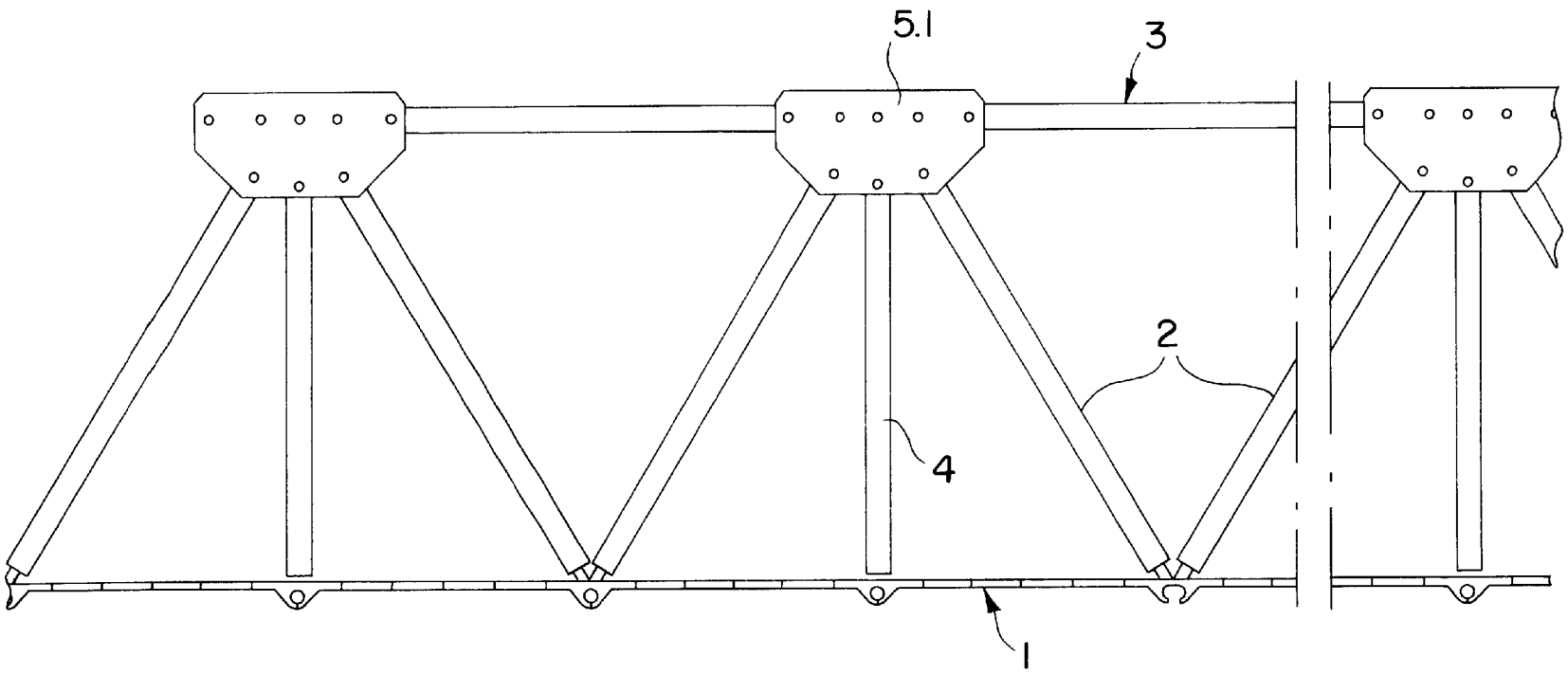
FIG. 1 shows a side view of an arrangement according to the invention on which it is possible to walk and/or drive.

According to FIG. 1, an arrangement on which it is possible to walk and/or drive has a bottom member 1 which, in accordance with DE 196 25 819 A1, is preferably made up of a plurality of panels. Details in this respect will not be given in the present invention.

Figure 2:
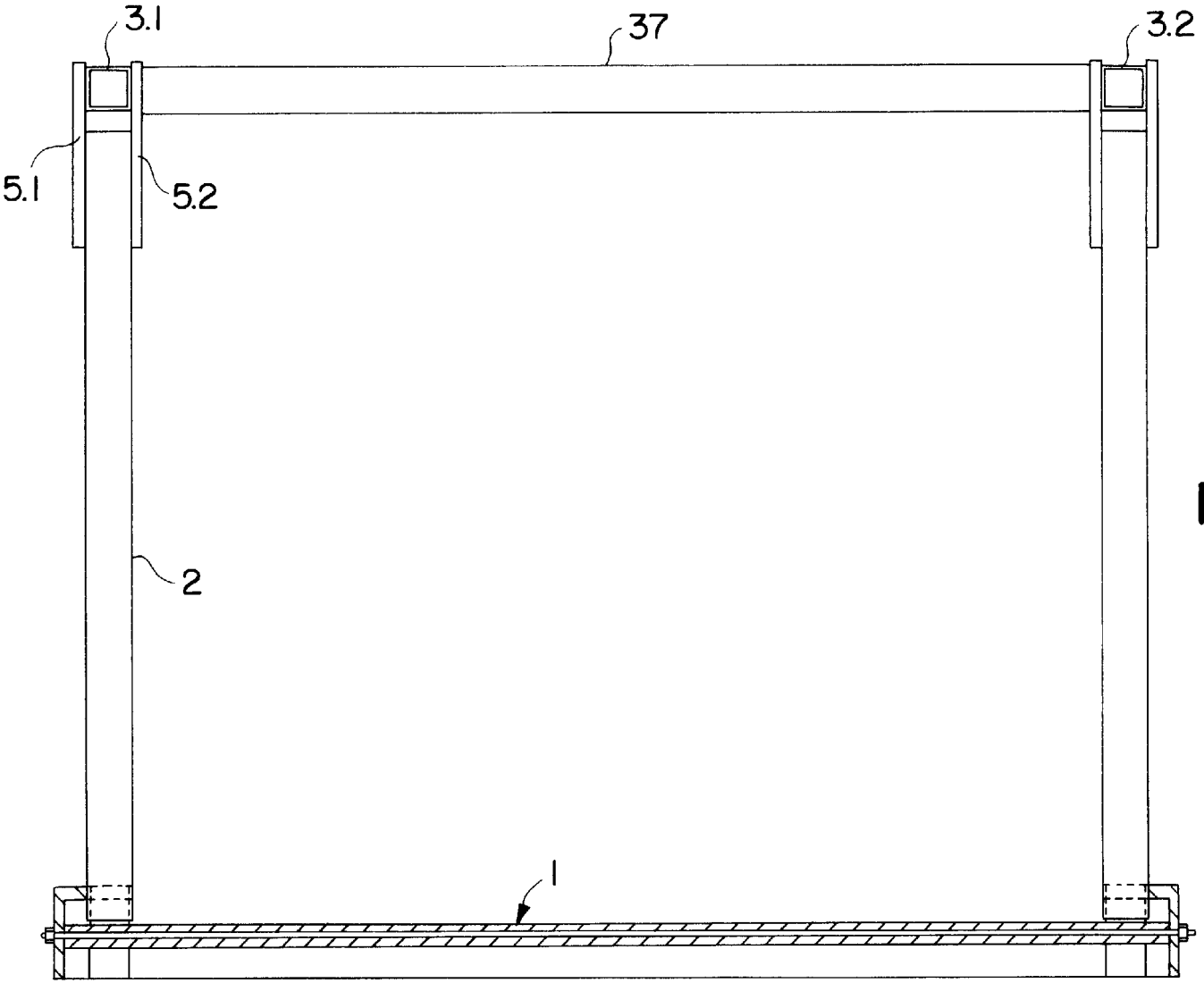
FIG. 2 shows a front view of the arrangement according to FIG. 1.

The bottom member 1 is connected, via cross-struts 2, to a top flange 3. Furthermore, a vertically running tension rod 4 is also provided, between the two cross-struts 2, between the top flange 3 and bottom member 1. Provided at the joint location between the cross-strut 2, top flange 3 and tension rod 4 are two side elements 5.1 and 5.2 (see FIG. 2), which cover over said joint location.

Figure 3:
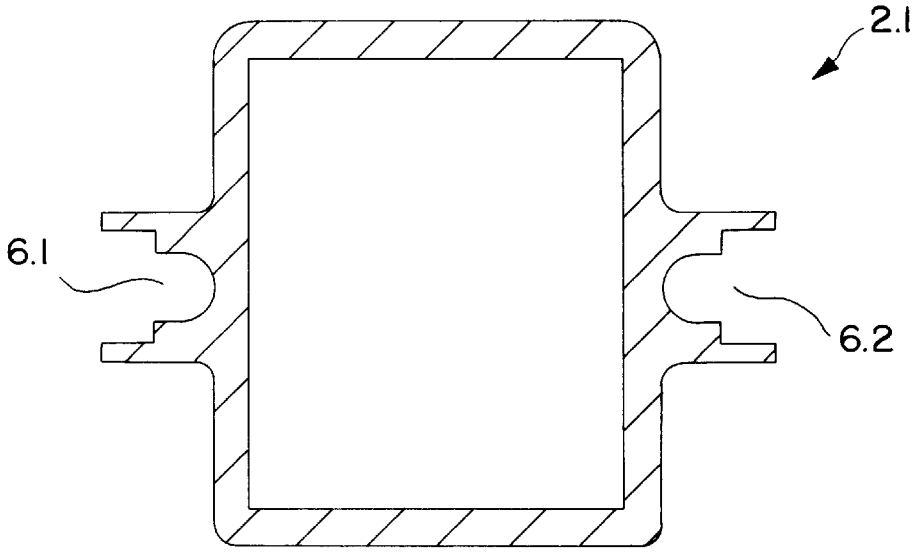
FIG. 3 shows a cross section through a cross-strut according to the invention.
Figure 4:
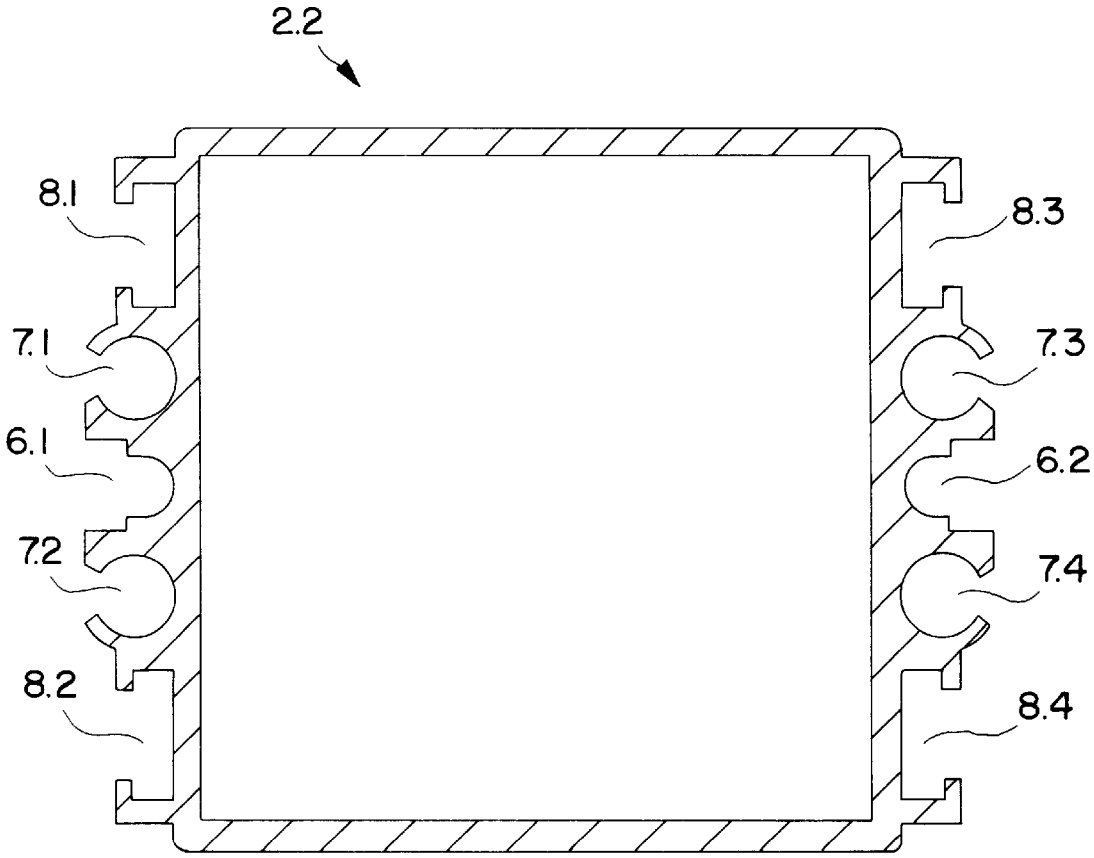
FIG. 4 shows a cross section through a further exemplary embodiment of a cross-strut according to the invention.

Two approximately parallel top flanges 3.1 and 3.2 are connected to one another, at a spacing apart, by roof struts 37. As a result, the arrangement on which it is possible to walk and/or drive is enclosed. According to the invention, a cross-strut 2.1 or 2.2 comprises, according to FIGS. 3 and 4, respectively, a closed box profile which has outwardly projecting profiling. In the case of the exemplary embodiment of the cross-strut 2.1 according to FIG. 3, two mutually opposite receiving channels 6.1 and 6.2 are provided for a panelling, which will be described at a later stage in the text. These receiving channels 6.1 and 6.2 also appear in FIG. 4. However, also provided in addition to the receiving channels 6.1 and 6.2 are tubular grooves 7.1 to 7.4, in which it is possible to fit, for example, a textile panelling described in DE 196 25 819 A1.

Furthermore, the cross-strut 2.2 also has T-shaped grooves 8.1 to 8.4, which serve for receiving an elastic element on which, for example in the use position, provided this profile is used as top flange 3, a roof sheet can rest.

Figure 5:
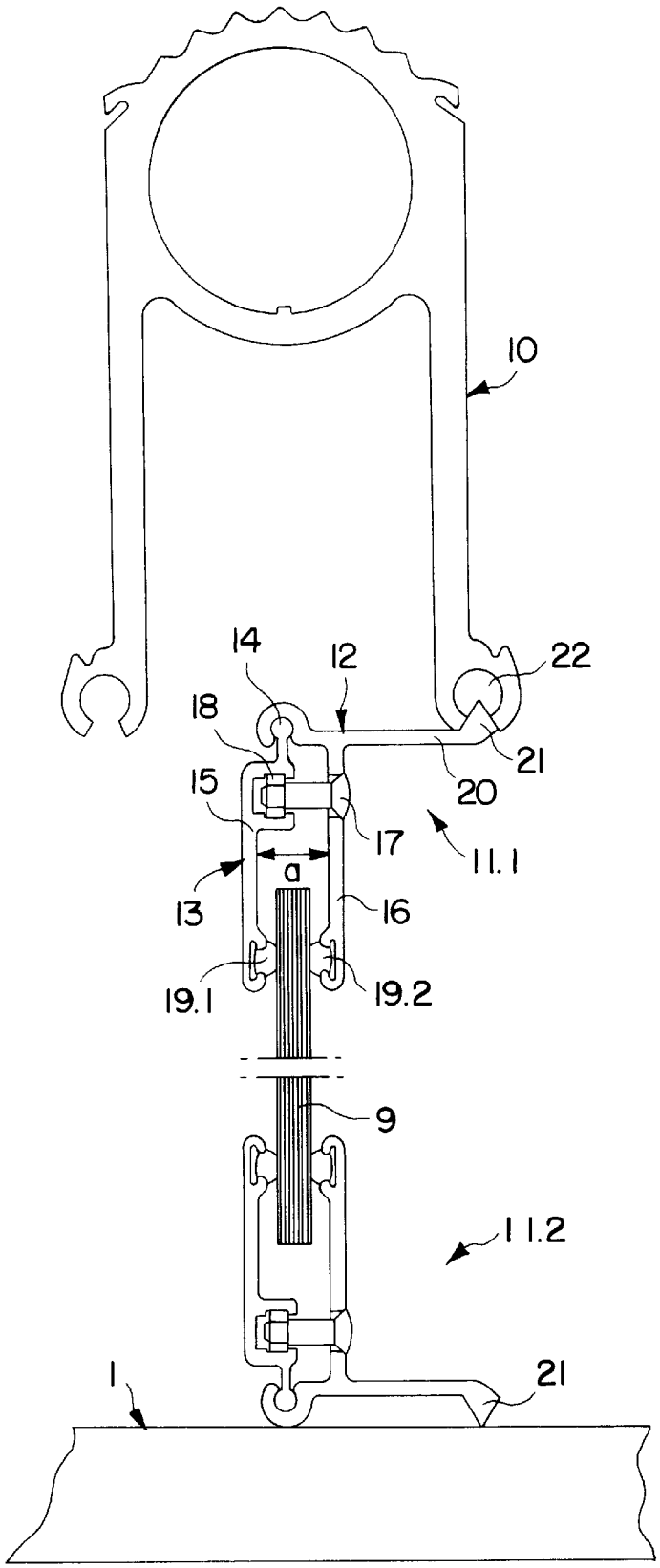
FIG. 5 shows a cross section through part of a further exemplary embodiment of an arrangement on which it is possible to walk and/or drive.

FIG. 5 portrays a possible way of securing a side panelling, which is indicated here as a glass panel 9. Said glass panel 9 is secured in the triangle between two adjacent cross-struts or between a cross-strut and a vertical tension rod 4. Securing must also, however, take place in the upward direction toward a handrail 10 and in the downward direction towards the bottom member 1. Provided for this purpose are clamping devices 11.1 and 11.2, which are preferably of identical design. In this case, each clamping device 11.1 and 11.2 has a clamping holder 12 and a clamping piece 13. The clamping piece 13 is connected to the clamping holder 12 via an articulation 14, with the result that it is possible to change a spacing a between a leg 15 of the clamping piece 13 and a supporting leg 16 of the clamping holder 12. The change is brought about by a tension connection, which in the present exemplary embodiment comprises a tension bolt 17, which passes through the supporting leg 16, and a nut 18, which is fixed on the leg 15. If the tension bolt 17 is screwed into the nut 18, then the spacing a is reduced, with the result that elastic clamping strips 19.1 and 19.2 are pressed onto the glass panel 9 from both sides.

An arm 20, on which a latching nose 21 is integrally formed at the end, projects approximately at right angles to the supporting leg 16. In the use position, said latching nose 21, in the case of the clamping device 11.1, engages in a groove 22 of the handrail 10, whereas the latching nose 21 of the clamping device 11.2 is supported on the bottom member 1, if appropriate against a rib or the like.

Figure 7:
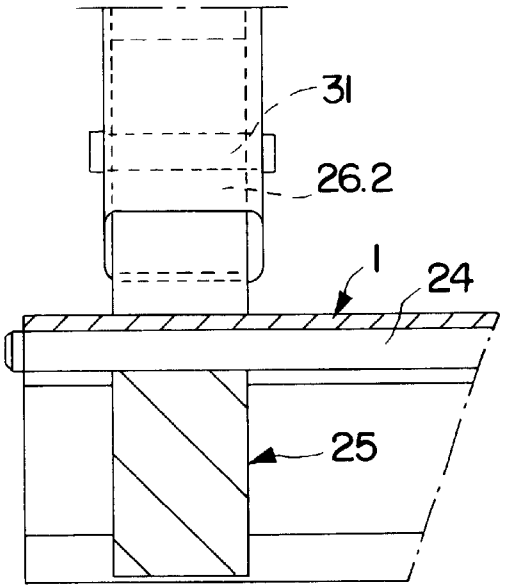
FIG. 7 shows a cross section through the part according to FIG. 6, the section being taken along line VII—VII.
Figure 6:
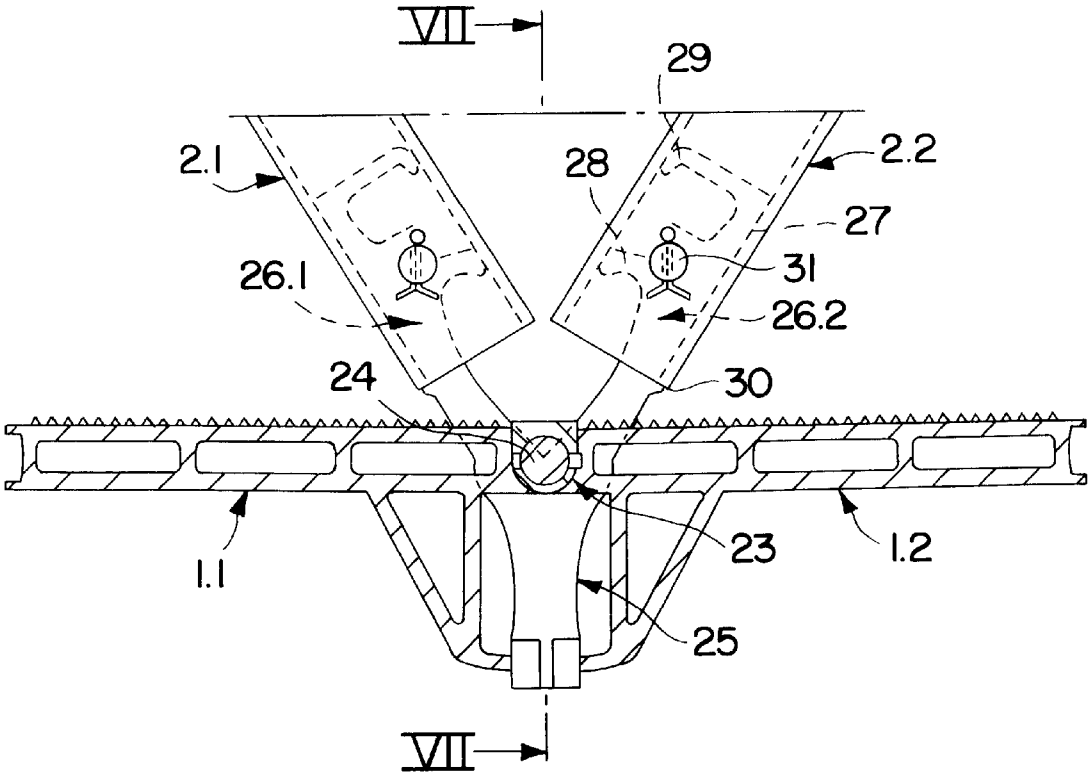
FIG. 6 shows a longitudinal section through part of a further exemplary embodiment of an arrangement on which it is possible to walk and/or drive.

FIGS. 6 and 7 indicate a possible way of fastening cross-struts 2 in the vicinity of the bottom member 1. Of the bottom member 1, two panels 1.1 and 1.2 are indicated in FIG. 6, and these are connected to one another at a joint location 23 in a hinge-like manner via a joint rod 24, as is described in DE 196 25 819 A1. This joint rod 24 has pushed onto it a connecting piece 25 which is of Y-shaped configuration, with the result that the two branches 26.1 and 26.2 project upward. Each branch 26.1 and 26.2 is inserted in a cross-strut 2.1 and 2.2, respectively, the branch butting against the interior of the cross-strut 2.1 or 2.2 in each case by a spine 27, on the one hand, and by two supporting fingers 28 and 29, on the other hand.

When the cross-strut 2.1 or 2.2 is plugged onto the branch 26.1 or 26.2, respectively, it strikes against a stop 30, which limits the plug-in depth. The cross-strut 2.1 or 2.2 is secured by a securing bolt 31, which is inserted through the cross-strut 2.1 or 2.2 and through the branch 26.1 or 26.2, respectively.

Figure 8:
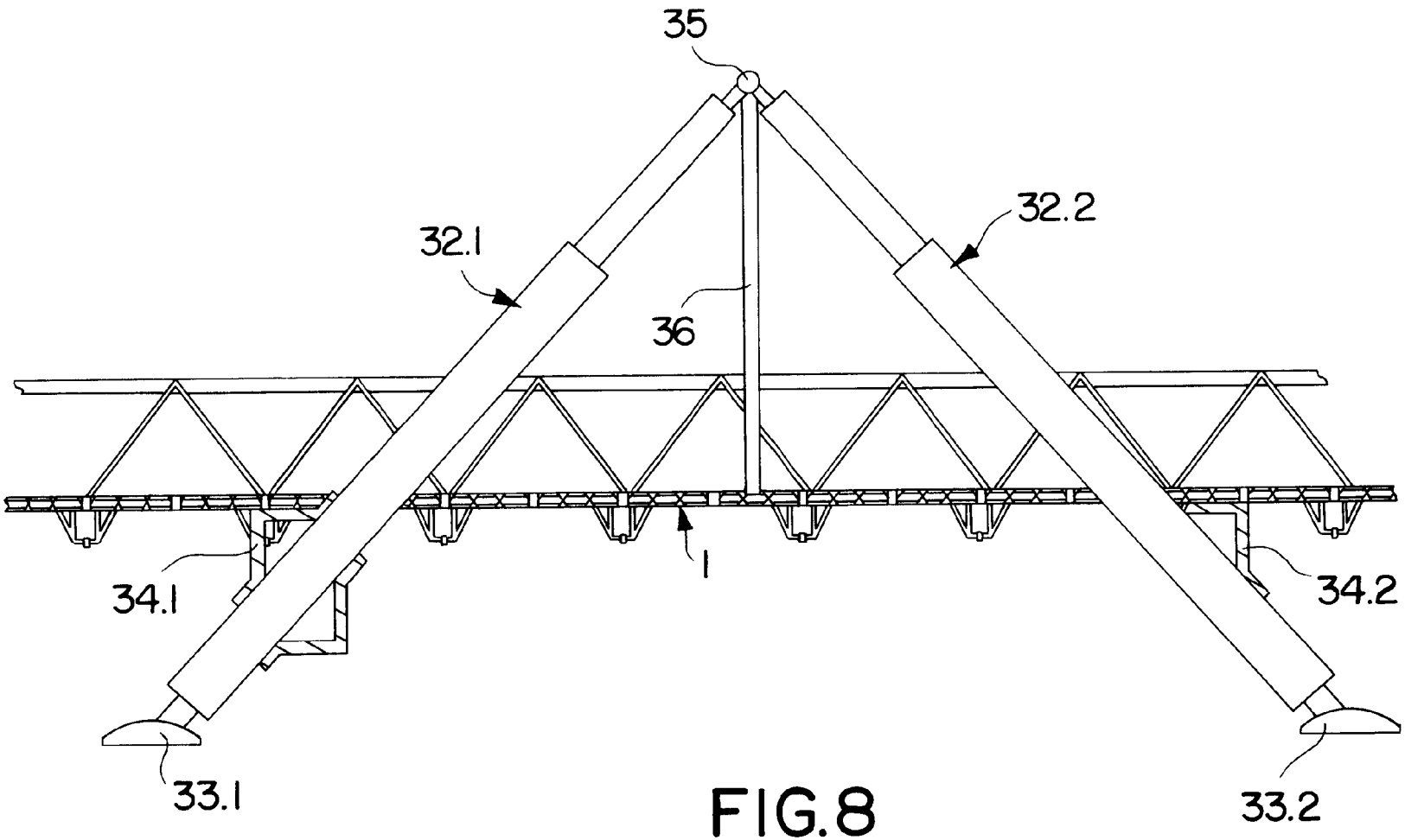
FIG. 8 shows a schematically illustrated side view of a further exemplary embodiment of an arrangement on which it is possible to walk and/or drive.

The embodiment of the arrangement according to the invention on which it is possible to walk and/or drive and which is shown in FIG. 8 is suitable, in particular, for flood areas, in which it is intended to change the spacing of the arrangement from an underlying surface or a water level. Provided for this purpose are two supports 32.1 and 32.2, which are positioned on an underlying surface by corresponding supporting feet 33.1 and 33.2. It is also indicated in the drawing that the supports 32.1 and 32.2 can be changed in length, i.e. can be telescoped. For the sake of simplicity, this can be achieved in that two tubes of different diameters can be plugged one inside the other and displaced one inside the other.

Arranged on the supports 32.1 and 32.2 are brackets 34.1 and 34.2, respectively, which can be displaced along the supports 32.1 and 32.2 and fixed in predetermined positions. It is also possible to position on each bracket 34.1 and 34.2 a transverse profile for placing beneath the bottom member 1.

The two supports 32.1 and 32.2 are connected to one another at their top end by an articulation 35. The bottom member 1 hangs on the articulation 35 via a suspension means 36.

What is claimed is:

1. A device for walking on or driving on, which comprises:

a bottom member;

cross-struts connected to said bottom member;

a top flange connected to said bottom member by said cross-struts;

wherein, said cross-struts have a closed box profile closed on four sides, and wherein the closed box profile includes at least one profiling for the insertion of a structural element.

2. A device according to claim 1, including a handrail connected to said bottom member and supported at least in part by said bottom member.

3. A device according to claim 1, including a tension rod connected to said bottom member and extending between said bottom member and top flange and extending between the cross-struts.

4. A device according to claim 1, including two approximately parallel top flanges connected to one another by roof struts.

5. A device according to claim 4, including a roof resting on the top flanges.

6. A device according to claim 4, including a joint location for said cross-struts, at least one top flange and at least one roof strut, which is covered over by two side elements.

7. A device according to claim 1, wherein the closed box profile includes at least one groove for the insertion of an elastic support for the roof member.

8. A device according to claim 1, wherein the closed box profile includes at least one receiving channel for the insertion of side panelling.

9. A device according to claim 1, wherein the closed box profile includes at least one tubular groove for receiving side panelling.

10. A device according to claim 1, including supports connected to said bottom member for providing support on an underlying surface.

11. A device according to claim 10, including brackets on which the bottom member rests positioned on the supports.

12. A device according to claim 10, wherein the supports are telescoping.

13. A device according to claim 10, wherein at least two supports are connected to one another at their top end via an articulation.

14. A device according to claim 13, wherein a suspension means leads from the articulation to the bottom member.

15. A device according to claim 13, wherein the supports are designed as four-sided profiles.

16. A device for walking on or driving on, which comprises:

a bottom member;

cross-struts connected to said bottom member;

a top flange connected to said bottom member by said cross-struts;

wherein, said cross-struts have a closed box profile closed on four sides; and including side paneling fixed between the cross-struts, wherein the side paneling is retained by a clamping device between a handrail and the bottom member.

17. A device according to claim 16, wherein said side panelling is supported at least in part by said bottom member.

18. A device according to claim 16, wherein the clamping device includes a clamping holder and a clamping piece, which can be moved relative to one another.

19. A device according to claim 18, wherein said clamping piece, at one end thereof, is connected to said clamping holder in an articulated manner, and wherein said clamping piece includes a tension connection at a spacing from said one end.

20. A device according to claim 18, wherein said clamping device is connected to at least one of the handrail and the bottom member in a releasable manner.

21. A device for walking on or driving on, which comprises:

a bottom member;

cross-struts connected to said bottom member;

a top flange connected to said bottom member by said cross-struts;

wherein, said cross-struts have a closed box profile closed on four sides; and wherein the cross-struts are fitted into a connecting piece which is connected to the bottom member in an articulated manner, with each connecting piece having a branch which is inserted in a cross-strut, and with said connecting piece having a stop for the cross-strut, wherein the branch is supported against inner surfaces of the cross-struts by spines and supporting fingers.

22. A device according to claim 21, wherein a securing bolt is inserted through said branch and cross-strut.

23. A device according to claim 21, wherein two of said branches are connected to form a Y-shaped connecting piece for retaining two of said cross-struts.

* * * * *